US006907029B2

(12) United States Patent
Brabrand

(10) Patent No.: US 6,907,029 B2
(45) Date of Patent: Jun. 14, 2005

(54) REMOTE CONTROL SYSTEM

(76) Inventor: Tord Brabrand, Gamleveien 48, N-3121, Tønsberg (NO)

( * ) Notice: Subject to any disclaimer, the term of this patent is extended or adjusted under 35 U.S.C. 154(b) by 215 days.

(21) Appl. No.: 10/108,724

(22) Filed: Mar. 29, 2002

(65) Prior Publication Data

US 2002/0163905 A1 Nov. 7, 2002

Related U.S. Application Data

(60) Provisional application No. 60/279,446, filed on Mar. 29, 2001.

(30) Foreign Application Priority Data

Mar. 29, 2001 (NO) ..... 2001 1604

(51) Int. Cl.[7] ..... H04B 72/12
(52) U.S. Cl. ..... 370/347; 340/10.2; 340/10.52
(58) Field of Search ..... 370/347; 340/10.2, 340/10.1, 10.51, 10.52, 825.69, 825.72, 825.52

(56) References Cited

U.S. PATENT DOCUMENTS

| | | | | |
|---|---|---|---|---|
| 4,334,221 A | | 6/1982 | Rosenhagen et al. | |
| 5,098,110 A | | 3/1992 | Yang | |
| 5,168,271 A | | 12/1992 | Hoff | |
| 5,452,901 A | | 9/1995 | Nakada et al. | |
| 5,544,075 A | | 8/1996 | Janex | |
| 5,881,366 A | | 3/1999 | Bodenmann et al. | |
| 5,885,159 A | | 3/1999 | DeAngelis | |
| 5,944,609 A | | 8/1999 | Crane et al. | |
| 6,088,457 A | * | 7/2000 | Parkinson et al. | 340/825.72 |
| 6,421,328 B1 | * | 7/2002 | Larribeau et al. | 370/343 |
| 2002/0105930 A1 | * | 8/2002 | Sydon et al. | 370/347 |

FOREIGN PATENT DOCUMENTS

| | | |
|---|---|---|
| DE | 195 02 839 C1 | 6/1996 |
| EP | 0 197 556 B1 | 11/1995 |
| JP | 2000-51541 A | 2/2002 |
| JP | 2000051541 | 2/2002 |

OTHER PUBLICATIONS

WPI, Derwent, JP 3268271B2, Abstract, "Radio Remote-Control System for Controlling e.g. Remote–Control Car," Mar. 25, 2002.

* cited by examiner

*Primary Examiner*—Brian Zimmerman
(74) *Attorney, Agent, or Firm*—Birch, Stewart, Kolasch & Birch, LLP

(57) ABSTRACT

The invention relates to a remote control system wherein a plurality of remote control devices and remote control receivers may be operating simultaneously. A remote control device comprises input elements for providing electrical control signals, a transmitter, and a processing device arranged for receiving the control signals from the input elements, providing a coded signal to the transmitter, said signal being coded with a repeating frame format, wherein each frame comprises a number of data packets each contained in subsequent time slots, and wherein each data packet comprises a time slot identifier identifying the time slot in which the data packet is contained. A remote control receiver is arranged for decoding a signal having a corresponding repeating frame format. The invention provides simple and reliable operation, synchronizing, addressing and connection functions, high bandwidth utilization and high tolerance towards disturbances, interference and communication obstructions. The invention may advantageously be used for remotely controlling objects for playing or amusement, such as controllable toys and model vehicles.

12 Claims, 7 Drawing Sheets

REMOTE CONTROL SYSTEM

This application claims priority on provisional Application No. 60/279,446 filed on Mar. 29, 2001, the entire contents of which are hereby incorporated by reference.

TECHNICAL FIELD

The invention relates in general to remotely controlling objects, particularly objects used for playing or amusement, such as controllable toys and model vehicles.

More specifically, the invention relates to a remote control device for use in a communication coverage area wherein a plurality of remote control devices and remote control receivers may be operating simultaneously.

The invention also relates to a remote control receiver for providing process signals to an external object, adapted to be controlled by a remote control device, for use in an area where a plurality of remote control devices and remote control receivers may be operating simultaneously.

BACKGROUND OF THE INVENTION

Devices, systems and methods for remotely controlling objects, such as toys, are well known in the art. Usually, such systems are based on radio communication or optical, particularly infrared, communication. In a typical prior art use, a remote control device, comprising a transmitter, transmits a signal which is coded with a control information such as steering or velocity information. A corresponding receiver connected to the object to be controlled receives the transmitted signal. Electronic circuits derives the control information, which is forwarded to the appropriate control elements in the object.

A common problem related to such remote control systems arises when several remote control devices and several corresponding receivers are to be operated simultaneously in a common environment. Reliable system performance requires that the signal transmitted by one remote control device should only influence the corresponding receiver device.

RELATED BACKGROUND ART

Several solutions have been proposed to the problem of operating a plurality of remote controllers and corresponding receivers/objects simultaneously and individually.

U.S. Pat. No. 4,334,221 discloses a radio control system for a toy vehicle system comprising several controllers and several corresponding toys to be individually controlled. To this end, each controller is arranged to transmit a command burst repetitively and asynchronously, with a transmit duty cycle which is so low that a high probability exists for non-interference between the transmitted bursts. Each command burst contains a digital identity code assigned to a specific receiver. The identity codes are preselected in the control set and in the receiver by means of electromechanical switches.

Due to the low duty cycle of the communication, this solution provides a poor utilization of the available bandwidth. This in turn leads to increased response times and thus reduced overall performance. Furthermore, the use of switches for selecting the identity codes makes the operation cumbersome for the user, as the user must keep track of the identity codes used and select a code which is not busy at the moment. The disadvantages of this solution are more pronounced as the numbers of control sets and corresponding receivers increase.

U.S. Pat. No. 5,885,159 discloses a system for the individual remote operation of toy vehicles by means of a number of remote control devices or "pads". The transmission from the remote control device to the receivers in the vehicles is based on radio communications, and use of packets of signals. The number of repetitive operations of a button on a specific pad within a time interval determines the selected identity of the receiver (i.e. vehicle) with which the pad is to be used. Each receiver comprises switches for the selection of an identity associated with the receiver. The identity can thus not be selected or changed in a straightforward way, easily recognized and performed by playing children. Further, the communication bandwidth is apparently not well-utilized, as possible communication conflicts are resolved by duplicating signal packets sent by the pads.

SUMMARY OF THE INVENTION

It is an object of the present invention to provide a remote control device and a remote control receiver whereby the above mentioned disadvantages are eliminated or reduced.

It is a further object of the invention to provide a remote control device and a remote control receiver whereby the dynamic assignment of a remote control device to a corresponding remote controlled receiver is facilitated.

It is an additional object of the invention to provide a remote control device and a remote control receiver which utilize a fixed communication protocol format, making it possible to combine remote control equipment from different manufacturers, provided that the equipment complies with the protocol format.

It is a further object of the invention to provide a remote control device and a remote control receiver which provide simple operation, high bandwidth utilization, low power consumption, high operating reliability, low manufacturing costs, as well as high tolerance towards varying conditions such as external disturbances, interference and temporary communication obstructions.

It is a further object of the invention to provide a remote control system, comprising at least one remote control device and at least one remote control receiver, which may be operating in a common communication coverage area, wherein a remote control link easily can be established from one remote control device to one or more remote control receivers.

The above objects are achieved by the features set forth in the appended set of claims.

BRIEF DESCRIPTION OF THE DRAWINGS

Further details, features and advantages of the present invention will become apparent on reading the following description of a preferred embodiment of the invention, given by way of an illustrative and non-limiting example only, and from the accompanying drawings, in which.

DETAILED DESCRIPTION OF THE INVENTION

Figure 1:
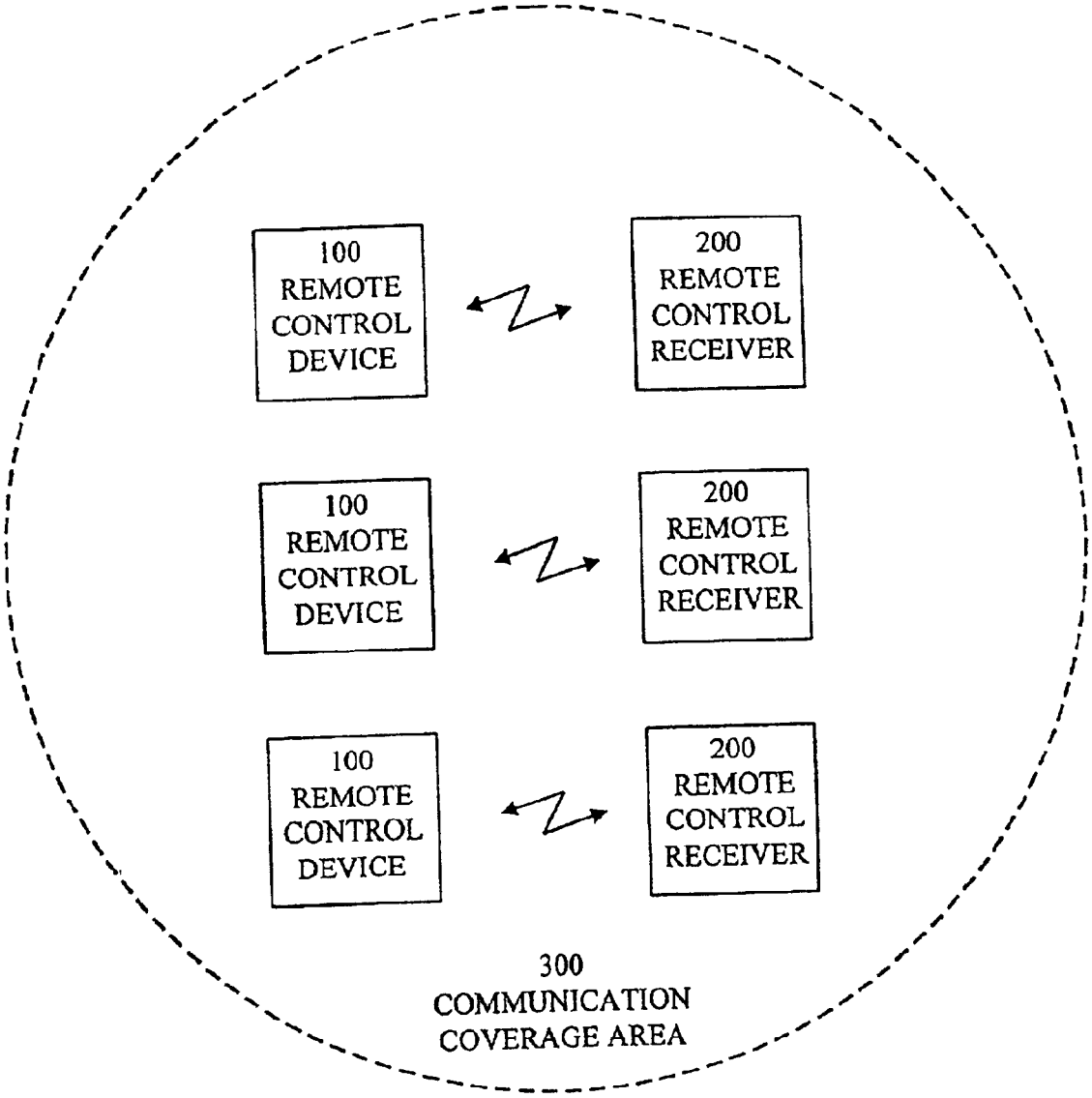
FIG. 1 is a schematic block diagram of a system wherein several remote control devices and corresponding remote control receivers operate in a common environment.

FIG. 1 is a schematic block diagram of a system wherein several (e.g. three) remote control devices 100 and several (e.g. three), corresponding remote control receivers 200 operate in a common communication coverage area 300.

Each of the remote control receivers 200 may be arranged as a built-in part of an object to be controlled. Such an object may e.g. be a toy vehicle such as a toy car. Each of the remote control receivers provide several control signals for controlling various parameters of the toy vehicle. Such control signals are typically electric digital or analog signals for the control of motors, steering devices, lights, sound devices etc. in the vehicle to be controlled.

Each of the remote control receivers 200 is assigned to only one remote control device 100. Each of the remote control devices 100 is preferably assigned to only one of the remote control receivers 200. However, one remote control device 100 may alternatively be assigned to more than one of the remote control receivers 200, in such a way that only one of them is controlled at a time. Operation of a specific control device 100 leads to an appropriate action in the corresponding, assigned remote control receiver 200, while the other receivers are not influenced by it.

Figure 2:
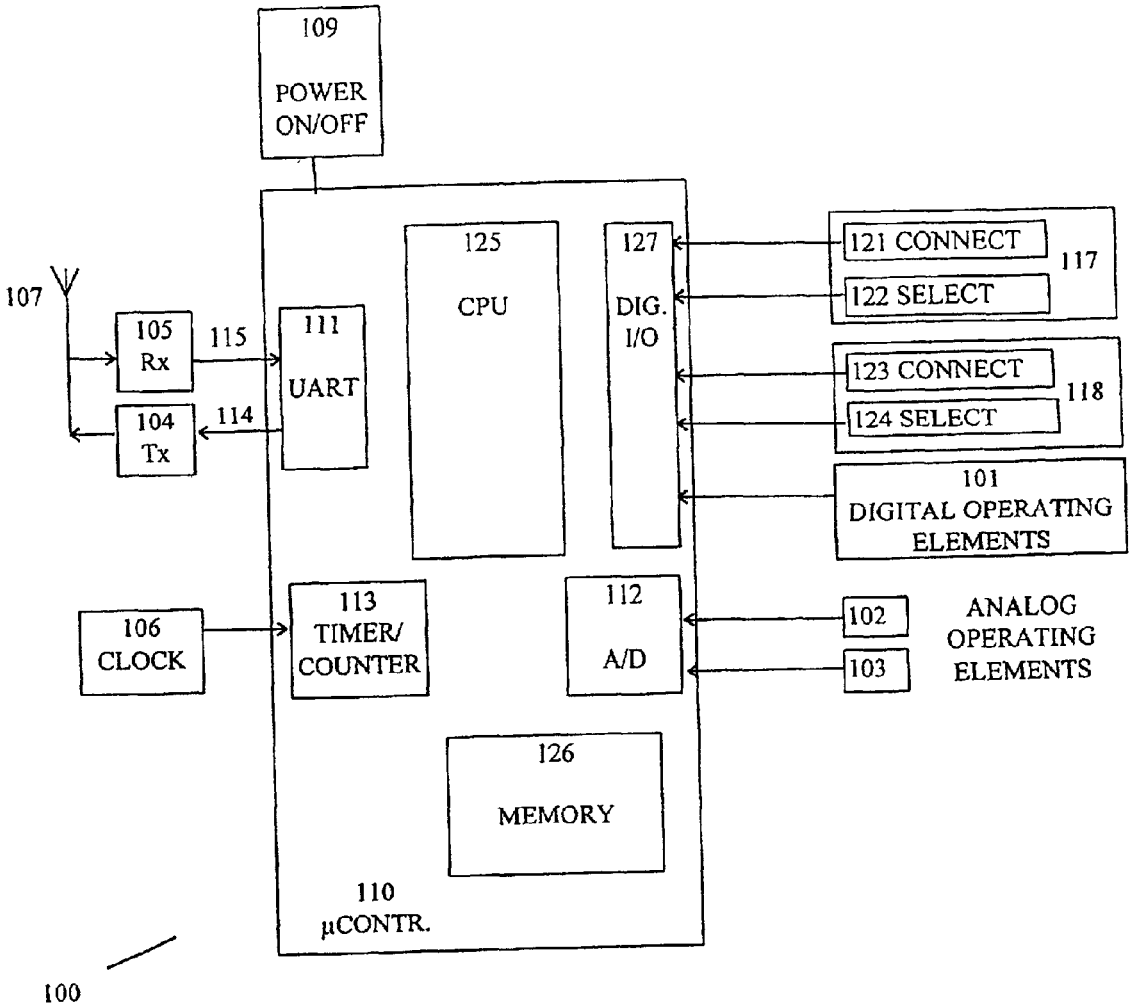
FIG. 2 is a schematic block diagram of the hardware configuration of a remote control device.

FIG. 2 is a schematic block diagram of the hardware configuration of a preferred embodiment of a remote control device 100.

The remote control device 100 comprises a processing device 110, preferably a microcontroller, which includes a central processing unit 125 and a memory 126, said memory comprising a read only memory (ROM) for the storage of fixed or preloaded program portions and data, a random access memory (RAM) for the storage of volatile or temporary data, and a semi-volatile memory area such as a battery-powered RAM, provided for storage of data when the device is switched off. While the microcontroller itself may be a standard electronic component, to be selected by a person skilled in the art, the contents of its read only memory, and hence the operation of said microcontroller, will be distinctive for the remote control device according to the invention.

The microcontroller 110 further comprises a serial input/output circuit (UART) 111. An output from the UART 111 is connected to the input of a radio transmitter unit 104. An input to the UART 111 is connected to the output of a radio receiver unit 105. The transmitter and receiver units are arranged to operate on the same frequency and to share a single antenna 107. An antenna selector device (not shown), controlled by an additional digital output (not shown) of the microcontroller, is preferably arranged to control such sharing operation. In this way, the microcontroller 110 is at any time able to either receive or transmit serial data, under its own control.

The microcontroller 110 is arranged to generate a running time base. To this end, the microcontroller utilizes its system clock 106, connected to a timing device, more particularly a timer/counter circuit 113, in the microcontroller 110. The running time base may be read and set by a software program portion stored in a memory and executed by the microcontroller 110. The running time base is used to increment a running >>time slot clock>> at correct intervals, so that this time slot clock is synchronised to the frame format 400. The time slot clock is a counter, e.g. a 4 bit counter, containing a value corresponding to the current time slot number of the frame format 400 at all times.

Each time the remote control device receives a data packet from another remote control device in the communication coverage area 300, the start point of the receipt of this transmission, regarded as a transmission start time, is noted by a software program portion stored in the memory. The data packet is transversed for computing a checksum, which is compared with the checksum actually transmitted. If the checksum is correct, the time slot identifier 410 contained in the data packet is used to set the time slot clock to its correct value. The transmission start time is then used to adjust the running time base, so that the time slot clock is incremented at the correct point of time at the beginning of the next time slot.

The remote control device 100 comprises a number of input elements 101, 102, 103. Preferably, the input elements 101 are digital operating elements connected to digital inputs included in a digital input/output portion 127 of the microcontroller 110, and they are arranged to be operated by a user. In the simplified embodiment shown, the operating elements 101 is a composite digital input device, e.g. comprising a number of operating switches arranged in an array, e.g. a 4×4 switch array. The operating elements 102, 103 are manually operated analogue input devices 102, 103, each providing a variable voltage signal to the inputs of a A/D converter module 112 provided in the microcontroller.

The remote control device 100 further comprises at least one composite operating device, each including first and second digital operating elements arranged to provide a "connect" signal and a "select" signal, respectively. In the embodiment shown, the remote control device 100 comprises two such operating devices 117, 118. To this end, the operating device 117 comprises a "connect" switch 121 and a corresponding "select" switch 122. Likewise, the operating device 118 comprises a "connect" switch 123 and a corresponding "select" switch 124. Each switch 121, 122, 123, 124 is arranged to be operated by a user, and is connected to its respective digital input of the digital I/O portion 127 of the microcontroller 110.

The remote control device 100 may be switched on or off by means of a power operating switch 109.

Figure 3:
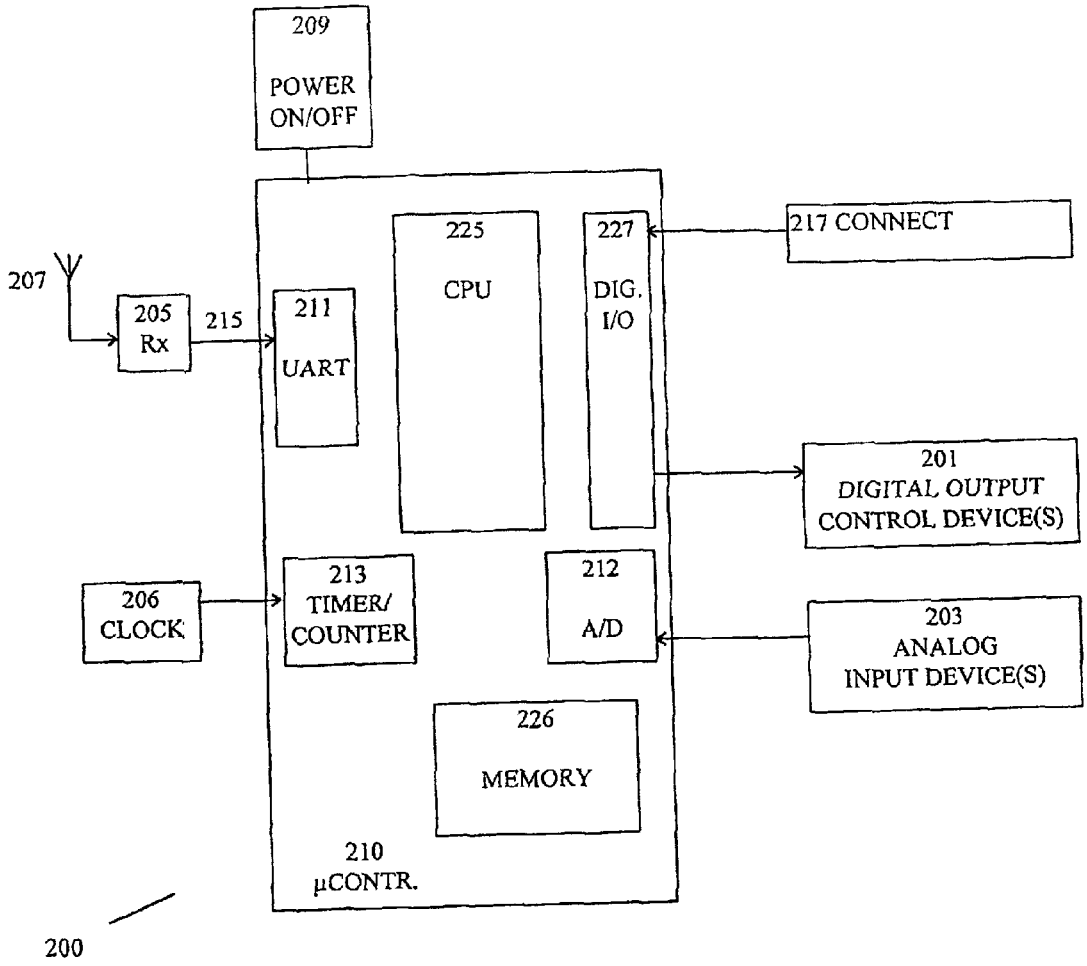
FIG. 3 is a schematic block diagram of the hardware configuration of a remote control receiver.

FIG. 3 is a schematic block diagram of the hardware configuration of a remote control receiver.

The remote control receiver 200 comprises a processing device 210, which advantageously is a microcontroller of substantially the same type and with similar hardware features as the microcontroller 110 used in the remote control device 100 described with reference to FIG. 2. The microcontroller 210 comprises a central processing unit 225 and a memory 226, said memory comprising a read only memory (ROM) for the storage of fixed or preloaded program portions and data, a random access memory (RAM) for the storage of volatile or temporary data, and a semi-volatile memory area such as a battery-powered RAM, provided for storage of data when the device is switched off. The contents of the read only memory, and hence the operation of the microcontroller 210, will be distinctive for the remote control receiver according to the invention.

The microcontroller 210 comprises a serial input/output circuit (UART) 211. An input to the UART 211 is connected to the output of a radio receiver unit 205, which preferably is of the same type as the receiver unit 105 in the remote control device 100 described with reference to FIG. 2. An antenna 207, connected to a RF input of the receiver unit 205, enables the microcontroller 210 to receive serial data.

The remote control receiver comprises at least one output control device 201, which may typically comprise digital driver circuits for controlling motors, steering means or similar electromechanical devices.

The remote control receiver 200 may further comprise a number of control input devices. In the preferred embodiment shown, a control input device 203 provides an analog voltage to an A/D-converter 212 provided in the microcontroller 210. The analog voltage is preferably a measurement signal which provides a feedback state from the vehicle, e.g. the steering position, to facilitate a servo loop for controlling the steering position.

The remote control receiver 200 may be switched on or off by means of an operating switch 209.

The microcontroller 101 provided in the remote control device according to the invention is adapted to generate a time multiplexed transmission protocol according to an outline described below, with reference to FIG. 4 and FIG. 5, and to transmit data according to this protocol. The microcontroller 201 provided in the remote control receiver 200 is adapted to interprete the data received through the receiver unit 205, according to the same transmission protocol.

Figure 4:
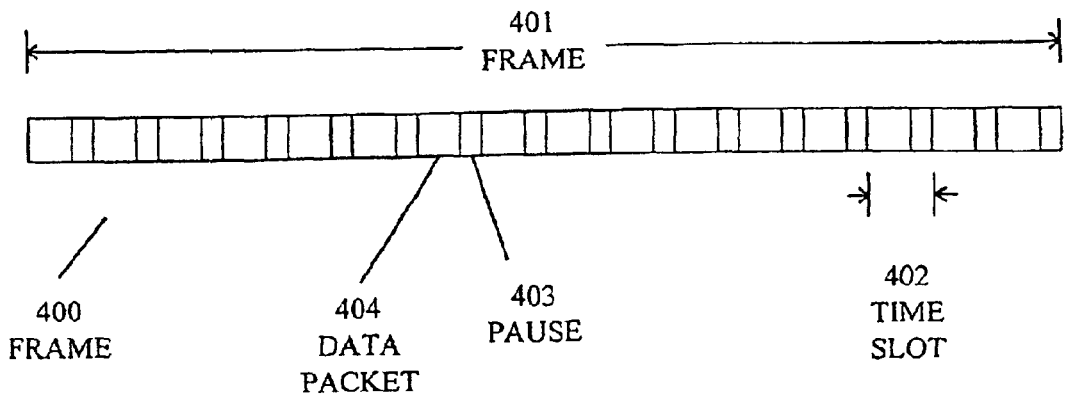
FIG. 4 is a time diagram illustrating the repeating frame format of a transmitted signal.

The signal generated and transmitted by the remote control device 100 has a continuously repeating frame format, illustrated in FIG. 4. The signal comprises frames 400, and each frame 400 has a fixed duration or length 401.

Each frame 400 is composed of a fixed number of subsequent time slots 402, each possibly comprising a data packet 404 and a pause 403 following each data packet 404. The number of time slots 402 (and hence the maximum number of data packets) contained in a frame 401 corresponds to the maximum number of remote control devices 100 that may be used in one and the same radio coverage area. Typically, 16 time slots 402 are arranged within one frame 401. Each time slot 402 contained in a frame can be uniquely identified by a time slot identifier, which typically can be a number in the range from 0 to 15. Every transmitted data packet contains such a time slot identifier, identifying the time slot in which the data packet is transmitted.

In the preferred embodiment, the frame has a fixed duration of 100 ms. The data packet may typically have a duration of 4.00 ms, whereas the pause 403 typically has a duration of 2.25 ms. Concequently, the overall duration of the time slot 402 is typically 6.25 ms.

Figure 5:
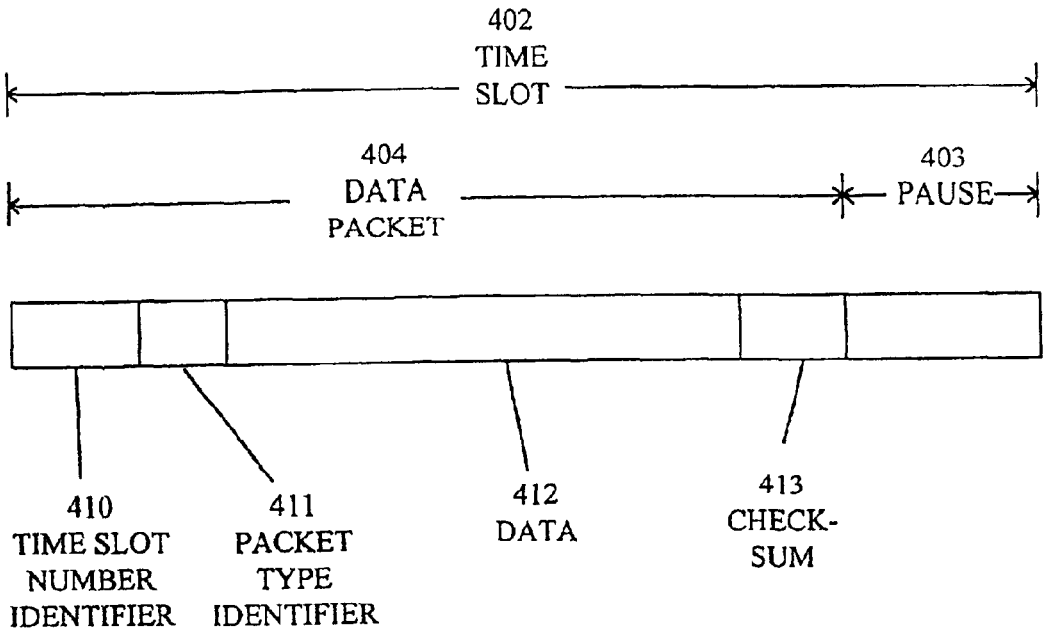
FIG. 5 is a time diagram illustrating the format of a data packet.

The contents of one data packet 404 in a time slot 402 is illustrated in more detail in FIG. 5.

The data packet 404 comprises a time slot identifier 410, typically 4 bits, preferably at the beginning of the data packet 404.

The subsequent data contained in the data packet 404 is a packet type identifier 411, typically 3 bits. The packet type identifier indicates one of a predetermined set of types of data packets. Possible data packet types described for this typical embodiment are <<connect packets>>, <<address packets)>>, <<billboard packets>> and <<control packets>>. Corresponding packet type identifier values are 001, 010, 000 and 011. Packet type identifiers 100, 101, 110, 111 may be reserved for future extensions of the protocol.

Next, the data packet contains a string of data 412, which may represent different information, depending on the data packet type. The data typically occupies 16 bits. This number of bits, and thus the total duration of the data packet, may vary in accordance with the data packet type. However, there is a maximum duration of the data packet that can not be exceeded. This maximum duration corresponds to the fixed time slot duration mentioned above.

Finally, the data packet contains a checksum 413, typically 4 bits.

It must be understood that the embodiment illustrated in FIG. 5 and the accompanying description is only meant to illustrate the principles of the invention. The important issue is that the following types of information can be identified and decoded from each—or a group of—data packets:

Time slot identifier.

Checksum.

Control information (e.g. velocity, steering position, etc).

<<Connect>> information including a choosen address.

<<Address>> information identifying the wanted receiver.

<<Billboard>> information indicating free and occupied time slots.

In a particular embodiment of the invention, each data packet can contain the whole—or parts of—one or more of these information types, and a person skilled in the art can easily find numerous ways of encoding the needed information into data packets. For technical—or other reasons, it might even be feasible to scramble the contents of each data packet in some predetermined way.

For instance, each data packet could consist of two distincte parts; one containing <<control information>> and one containing <<protocol information>>, such as time slot identifier, checksum, connect information, address information and billboard information.

The <<control>> part of the packet could contain its own <<control data identifier>>, identifying the type of control information contained in the packet, such as velocity, steering position, etc.

Likewise, the <<protocol>> part of the packet could contain a <<protocol data identifier>> identifying the information contained in this part of the packet. One could for instance define the following types of <<protocol parts>>, each identified by a particular protocol data identifier value:

1. Part containing: Time slot identifier, checksum, higher 8 bits of <<connect packet>> address.
2. Part containing: Time slot identifier, checksum, lower 8 bits of <<connect packet>> address.
3. Part containing: Time slot identifier, checksum, higher 8 bits of <<address packet>> address.
4. Part containing: Time slot identifier, checksum, lower 8 bits of <<address packet>> address.
5. Part containing: Time slot identifier, checksum, higher 8 bits of <<billboard register>>.
6. Part containing: Time slot identifier, checksum, lower 8 bits of <<billboard register>>.

In such an embodiment, the packets containing the <<high-<< and <<low-<< parts of related protocol information would be sent in the same time slot (as currently assigned to the remote control device), but in subsequent frames.

A number of data packets (all containing the same time slot identifier) would then have to be received to be able to assemble the various parts of each type of information.

Such types of embodiments of the invention could have certain advantages, such as higher bandwith utilization. It is however easier to explain the principles of the invention by use of the embodiment illustrated in FIG. 5. and the accompanying description.

The pause 403 represents a period of time wherein no data transmission takes place. The duration of the pause is given by the difference between the fixed duration of the time slot 402 and the duration of the data packet 404.

Figure 6:
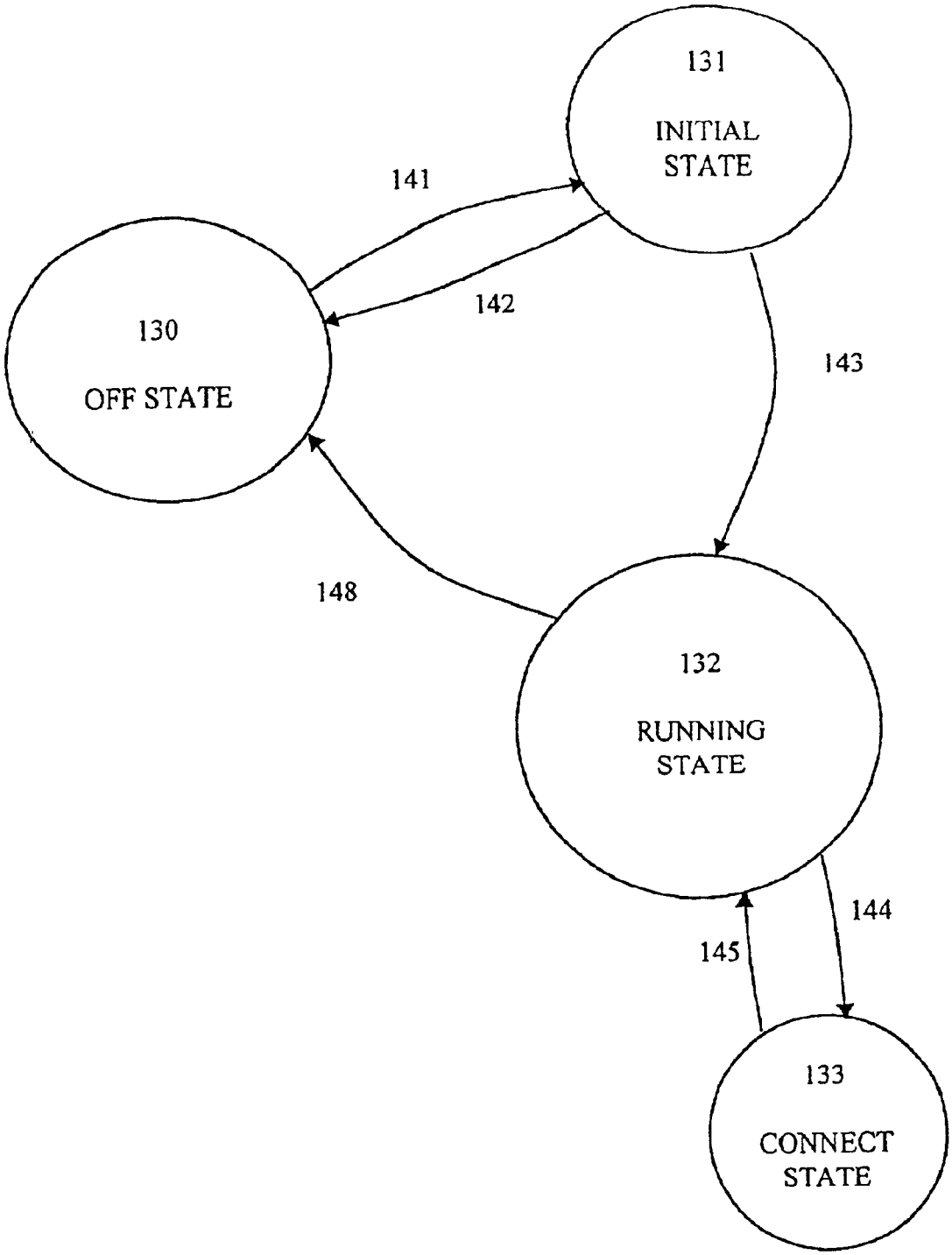
FIG. 6 is a state diagram illustrating the basic operation of the remote control device 100.

FIG. 6 is a simplified state diagram illustrating the basic operation of the remote control device 100.

The idle or shutdown state of the remote control device is illustrated at 130. This state corresponds to a state where the device is deactivated or switched off by the user.

When the remote control device 100 is switched on, transition 141 is effected, and the remote control device enters the initial state 131. This state 131 involves the performance of an initializing procedure of the remote control device 100. During this initializing procedure, the remote controller device 100 automatically selects a free time slot for its operation. This is accomplished by first receiving signals transmitted from other active, transmitting remote control devices that might be present in the communication coverage area, during a predetermined period of time, called a listening period, e.g. 10 times the duration of one frame 401. During this listening period, a so called <<billboard register>> is updated with data representing the time slots already in use by the other transmitting remote control devices. Such data are obtained from the time slot identifiers 410 which are always present in each data packet transmitted by any remote control device. In addition, information about free time slots may be obtained from so-called "billboard packets", which are regularly transmitted by all the remote control devices that are active in the area. The billboard packets will be further described below.

Subsequent to the end of the listening period, the remote control device examines the billboard register and determines if there are any free time slots available.

If there are no free time slots at the moment, the remote control device continues to search for a free time slot until one is found, or until the device is switched off. When at least one free time slot is available, one of the free time slots is selected. The remote control device advantageously selects from the billboard register the time slot number that was most recently used by this device, if such a number is stored and if this number is recognized from the billboard register as being free. Otherwise, the remote control, device selects a random time slot number among the numbers that are recognized as free.

When a time slot number is selected, the remote control device effects a transition 143 to the running state 132, which is the normal operating state for the remote control device. The selected time slot number will be valid for the remote control device as long as it remains in the running state 132, and all data packets transmitted by the remote control device will use and indicate this time slot number. In the running state 132, control data is transmitted to an assigned remote control receiver. The assignment of a remote control receiver will be described below.

In the running state 132, the main task for the remote control device 100 is to transmit control information to its currently assigned remote control receiver 200. In a typical embodiment of the invention, this is accomplished by sending data packets of the <<control packet>> type, identified by a predetermined packet type identifier value, such as 011. The data part of these packets contains control information such as motor speed and—direction, steering position, sound data, light data etc. It should be noted that the idea of a specific <<control packet>> type is meant for illustration only. Control information could just as well be combined with other types of information, such as address—and/or billboard information, and contained in other packet types.

In the running state, the remote control device transmits <<address packets>> at particular intervals, such as every 10 frames. In a typical embodiment of the invention, an address packet is identified by a predetermined packet type identifier value, such as 010. The data part of this packet contains an address (typically 16 bits) provided in a previously performed <<connect sequence>>, and currently held in the <<current address>> register, as explained below.

It should be noted that the idea of a specific <<address packet>> type is meant for illustration only. Addres information could just as well be combined with other types of information, such as control—and/or billboard information, and contained in other packet types. The address could also be split up and sent part by part in other types of packets.

In the running state 132, the remote control device continues to update the earlier mentioned billboard register. The billboard register comprises a binary flag for each time slot number, i.e. typically 16 flags. A particular binary flag value such as "1" in position n in the register indicates that the receiver part of the remote control device has registered transmitting activity from the remote control device which currently uses time slot number n, in a predetermined, recently passed period of time, such as during the last 255 frame periods. At regular intervals, such as every 10 frame periods, the remote control device 100 transmits a data packet of the "billboard packet" type, containing billboard information. Such a packet is identified by a predetermined binary packet type identifier, such as 000.

In the preferred embodiment of the invention, the 16-bits data part of a billboard packet contains the current contents of the billboard register. A "1" in bit no. n indicates that activity has been recently detected in time slot no. n. A "0" in bit no. n indicates that no activity has been recently detected in time slot no. n.

It should be noted that the idea of a specific <<billboard packet>> type is meant for illustration only. Billboard information could just as well be combined with other types of information, such as control—and/or address information, and contained in other packet types. The billboard information could also be split up and sent part by part in other types of packets.

The purpose of this billboarding function, whereby information about occupied time slots is forwarded by other remote control devices, is to minimize the probability that a remote control device, during the performance of its initial state, erroneously interprets a particular time slot to be free. This could likely have happened if the billboarding function was not implemented, in the case that the signals transmitted from a remote control device which occupies the particular time slot was not properly received during the initial state period, e.g. due to its temporary position in a dead zone, or due to other occasional disturbances.

The activation of a connect switch, such as the switch 121 in the first composite operating device 117, is typically performed by pressing a "connect pushbutton" 121 on the remote control device 100. At such activation, the remote control device enters the connect state 133 (transition 144). In this state, an address generator provided in the remote control device generates a random address of typically 16 bits. The generated address is stored in an address register associated with the connect switch 121. The address is also stored in a "current address" register, which contains the current address used by the remote control device at any time. The length of the address, and thus the number of possible addresses, is sufficiently large so as to obtain a low probability that two remote control devices used in the same area would select the same address. The remote control device 100 then repeatedly transmits "connect packets". A connect packet is identified by a predetermined binary packet identifier, such as 001. The subsequent 16 bits data part of this packet contains the generated address, mentioned above.

It should be noted that the idea of a specific <<connect packet>> type is meant for illustration only. Connect information (including the chosen address) could just as well be combined with other types of information, such as control—and/or address information, and contained in other packet types. The connect information could also be split up and sent part by part in other types of packets.

The remote control device remains in the connect state 133 until the connect function is deactivated (transition 145). Typically, this transition is performed when the connect pushbutton 121 is released. The remote control device returns to the running state 132.

The activation of a select switch, such as the select switch 122 in the first composite operating device 117, is typically performed by pressing a "select pushbutton" 122 on the remote control device (transition 146). At such an activation, the contents of the address register associated with the connect switch 121 that corresponds to the select switch 122, is transfered to the current address register. The contents of this current address register is then transmitted as <<address packets>> at regular intervals, as described above.

When the remote control device 100 is switched off (transition 148), it returns to the idle or shutdown state 130. Although not shown in FIG. 6, it is possible to return to the idle state 130 from any of the states 131, 133 and 134 as well, whenever the remote control device is switched off.

There may be arranged more than one connect switch and corresponding select switch, e.g. two connect switches 121, 123 and two select switches 122, 124, respectively, as illustrated in FIG. 2. The activating of any connect switch will again bring the remote control device into the connect state. This implies that another random address is generated and stored both in the address register associated with the connect switch and in the current address register. Connect packets containing this address are then transmitted. The purpose of the connect function is to establish a link between the remote control device and a remote control receiver. The receivers' response to transmitted connect packets is described below.

The activating of any select switch results in that the address stored in the address register associated with the corresponding connect switch is transferred to the current address register. This in turn leads to that a remote control receiver associated with this address is selected.

Figure 7:
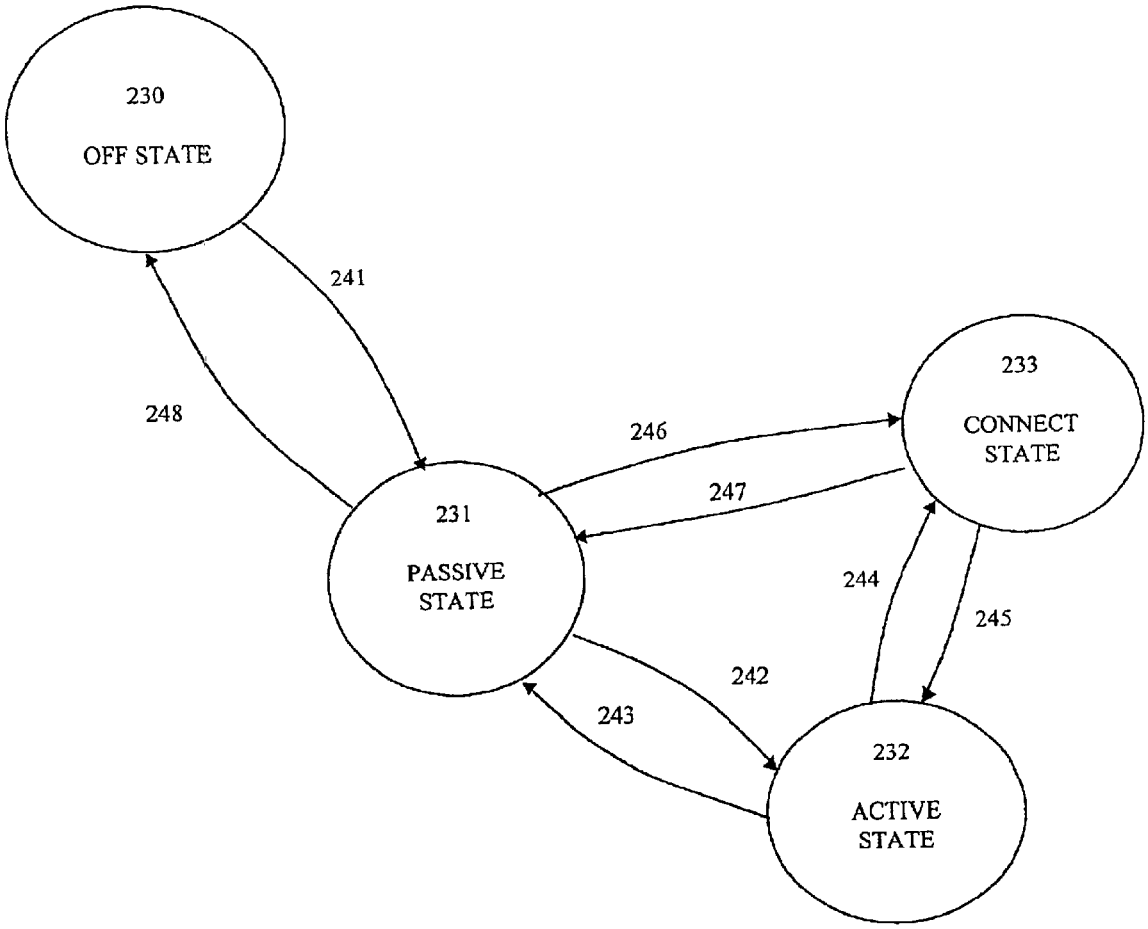
FIG. 7 is a state diagram illustrating the basic operation of the remote receiver device 200.

FIG. 7 is a simplified state diagram illustrating the basic operation of the remote control receiver 200.

The idle or shutdown state of the remote control receiver 200 is illustrated at 230. This state corresponds to a state where the receiver is switched off.

An address associated with the receiver 200 is stored in a semi-volatile memory register included in the memory 225. The contents of the address register may be a previously assigned address, a new address assigned via a received connect packet, or a random value if no particular address is assigned.

When the remote control receiver is switched on, the transition 241 is effected and the receiver enters the passive state 231. In this state the receiver has no assigned time slot to obey, and should thus not react to any received control information.

In the passive state 231, the receiver is searching for address packets in any time slot, which contain an address matching the address stored in the address register of this device. Once such an address match is found, the time slot number contained in the packet with the matching address is stored as this receiver's <<current time slot>> in the current time slot register, which is also a register included in the memory 225. The receiver then enters the active state 232 (transition 242). In the active state 232 the receiver reacts to control information received in the <<current time slot>> given by the current time slot register.

While in the active state 232, the receiver continues to check if address packets received in the <<current time slot>> still contains the address stored in the address register. If a different address is detected in this time slot, the receiver enters the passive state 231 again (transition 243).

While in the active state 232, the receiver also monitors if the address stored in its address register appears in another time slot. If this occurs, the time slot number of this time slot is stored in the current time slot register. This may happen if the transmitting remote control device for some reason changes the time slot used for the transmission.

While in the passive state 231, at the activation of a connect switch 217, typically performed by pressing the connect pushbutton 217 on the remote control receiver 200, the receiver enters the connect state 233 (transition 246). Correspondingly, while in the active state 232, the activation of the connect switch also brings the receiver into the connect state 233 (transition 248).

In the connect state 233, the microcontroller 210 in the remote control receiver 200 is adapted to derive data packets from the data received from the radio receiver unit, and further to detect if a received data packet is a connect packet, utilizing the data packet's packet type identifier field. If the packet is recognized to be a connect packet, the address contained in the address field in the connect packet is assigned as the remote control receiver's current address, by storing the address in the address register in the receiver's memory. In addition, the time slot number of the connect packet is assigned as the receiver's current time slot number, by storing the time slot number in the time slot register in the receiver's memory.

In this way, a remote control device 100 whose connect switch 121, 123 is currently being activated, will be assigned to the remote control receiver 200 whose connect switch 217 is simultaneously activated.

The remote control receiver remains in the connect state 233 until the connect function is deactivated. Typically, this deactivation is performed by releasing the pushbutton 217.

If a connect packet was received in the recent connect state period, or if the receiver 200 had an assigned time slot prior to the connect state period, the deactivation brings the receiver 200 into the active state 232 (transition 245).

If no connect packet was received in the recent connect state period, and if the receiver did not have an assigned time slot prior to the connect state period, the deactivation brings the receiver 200 into the passive state 231 (transition 248).

In the active state 232, the main task for the remote control receiver device is to receive data packets of the "control packet" type and convert its contents to control data to be supplied to control devices 201.

The received data packets are processed by the microcontroller, and data packets where the time slot identifier matches the assigned <<current time slot>> number are derived. A control packet is identified by a predetermined binary packet type identifier, such as 011, subsequent to the introductory time slot number. The data part of this packet contains specific control information to be interpreted by the microcontroller 210, which generates corresponding control signals which are supplied to the control members 201, 202, thus controlling motors, speed, steering, sound, light etc.

If the received data packet is a control packet, the time slot number is used as the valid identification link between the remote control device 100 and the receiver 200. If a received data packet is an address packet, the match between addresses will become predominant. This results in that the time slot number of this address packet will be assigned as the receiver's current assigned time slot number, provided that the address in an address packet matches the receiver's assigned address.

At the reactivation of the connect switch 217, the remote control receiver again enters the connect state 233 (transition 244). This makes it possible to perform a new address assignment.

When the remote control receiver 200 is switched off (transition 248), it returns to the idle or shutdown state 230. Although not shown in FIG. 7, it is possible to return to the idle state 230 from any of the states 231, 232 or 233 as well, whenever the remote control device is switched off.

It will of course be understood that the invention is not limited to the specific details described herein, which are given by way of example only. It is thus evident to the skilled person that various modifications and alterations are possible within the scope of the invention.

For instance, although the frame period should be of fixed duration, the actual duration may be varied according to the application in question. Although the number of time slots in one frame should be a fixed number, the actual number may likewise be varied, dependent on the actual application.

The actual coding of the information in each time slot can of course be done in many different ways. For instance, billboard information and address information may be split up and sent part by part in successive frames together with control information, instead of dedicating single packets to each type of information.

The physical communication has been described particularly with reference to radio communications. However, it will be obvious to the skilled person that the disclosed inventive concept may be used with optical, particularly infrared, or sonic, particularly ultrasonic, communication as well. In this case, the transmitter and receiver circuits should of course be substituted by the desired, equivalent physical communication elements. The invention could even be useful in applications using cable bound communications, such as instrumentation—and control networks.

The serial input/output circuit specified as an UART 211 can be replaced by another data encoding/decoding device, suitable to the chosen modulation type and the physical communication medium used.

The remote control device and remote control receiver may be designed with the microcontroller and its peripheral circuits as separate components on a circuit board. Likewise, the inventive concept may be realized with other types of electronic circuits, such as programmable logic devices (PLDs) or application specific integrated circuits (ASICs).

The output control device 201 is indicated by example as a digital driver circuit. It could of course alternatively be realized as an analog circuit, in which case it would be connected to the output of an D/A-converter included in or connected to the microcontroller 210 in the remote control receiver 200. The number of such devices may naturally be varied, according to the requirements of the application.

The types of input elements 101, 102, 103, as well as the number of input elements, are of course described by example only. They may consequently be formed as any set of suitable digital or analog input elements dependent on the actual application. The input elements should not only be comprehended as manually operated input devices. They may also be constituted by indirectly operated elements such as e.g. digital interface circuits providing operating signals from an external device, e.g. a personal computer.

The illustrated embodiment discloses two composite operating devices 117, 118, each providing a connect signal and a select signal. It should be understood that the number of such operating devices included in a remote controller device could be one, two, three or more. By example, each operating device is illustrated as comprising two separate switches, such as push-button switches; one connect switch and a corresponding select switch. The skilled person will realize that each operating device could alternatively include only one push-button switch, and that the state of a common selector switch determines if each device should provide a connect signal or a select signal when the push-button switch is operated.

The use of the invention has been described with reference to toys, model vehicles and the like. Examples of such toys or vehicles are remotely controllable cars, racing cars, offroad vehicles, trucks, tractors, excavators, trains, boats, aeroplanes, helicopters, toy animals, dolls and toy robots. In addition to such movable objects, the invention may also be used with stationary playing equipment like cranes, bascule bridges, electronic equipped houses, elevators, etc. Although the resulting simple, user-friendly and robust operation makes such toys and models the main application field for the invention, the invention could also be used for other purposes, including the control of real machines, such as cranes, garage doors etc. Further applications include remote control communication between computer devices, such as the control of a personal computer or a game console by means of a wireless input equipment (e.g. keyboard, mouse, roller ball or joystick). The invention could also be used for providing communication in an instrumentation or automation system, such as a home automation system.

What is claimed is:

1. A remote control device for use in a communication coverage area wherein a plurality of remote control devices and remote control receivers may be operating simultaneously, for remotely controlling a remote control receiver operating in said area, the device comprising:

input elements for providing electrical control signals;

a transmitter;

a processing device arranged for receiving the control signals from the input elements and for providing a coded signal to the transmitter, said coded signal being coded with a repeating frame format, wherein each frame comprises a number of data packets each contained in subsequent time slots, and wherein each data packet comprise a time slot identifier identifying the time slot in which the data packet is contained;

a receiver connected to the processing device, the processing device being arranged to obtain a time slot identifier from the data packets received by the receiver; and a timing device connected to the processing device, whereby the processing device is arranged to control the timing of the coded signal provided to the transmitter, the processing device being arranged for receiving time slot identifiers from other remote control devices in the area, and for updating a billboard register, indicating presence of activity within a recently passed period of time, of remote control devices associated with each time slot number.

2. The remote control device according to claim 1, further comprising a memory, including an address register, containing the address currently assigned to the device.

3. The remote control device according to claim 2, wherein the memory further comprises a time slot number register, containing the time slot number currently assigned to the device.

4. The remote control device according to claim 1, wherein the processing device is arranged to adjust the timing device according to the arrival time of a data packet received by the receiver or the arrival time of a time slot identifier contained in such a packet.

5. The remote control device according to claim 1, wherein the processing device is arranged to provide billboard packets to the transmitter at predetermined intervals, said billboard packets comprising data from the billboard register.

6. The remote control device according to claim 1, wherein the processing device is arranged to perform an initializing procedure, in which a free time slot number is derived from the billboard register or from received billboard packets, or both and to assign this time slot number for the further operation of the remote control device.

7. The remote control device according to claim 1, wherein the processing device is arranged to provide data packets to the transmitter, said data packets comprising the time slot identifier, a packet type identifier and a data field containing control data.

8. The remote control device according to claim 1, further comprising at least one first activating element, wherein the processing device is arranged to, upon the activating of the first element, to generate a pseudo random address, to store said address in an address register associated with the first activating element, and to transmit one or more data packets containing either the complete said address in each data packet, or an identifiable part of said address in each data packet.

9. The remote control device according to claim 8, further comprising at least one second activating element, each associated with a corresponding first activating element, wherein the processing device is arranged to, upon the activating of the second element, to transfer the content of the address register associated with the first activating element to the address register containing the address currently assigned to the device.

10. The remote control device according to claim 1, wherein the processing device is arranged to periodically transmit one or more data packets containing the address currently assigned to the device, either the complete said address in each data packet, or an identifiable part of said address in each data packet.

11. A remote control device for use in a communication coverage area wherein a plurality of remote control devices and remote control receivers may be operating simultaneously, for remotely controlling a remote control receiver operating in said area, the device comprising:

input elements for providing electrical control signals;

a transmitter;

a processing device arranged for receiving the control signals from the input elements and for providing a coded signal to the transmitter, said coded signal being coded with a repeating frame format, wherein each frame comprises a number of data packets each contained in subsequent time slots, and wherein each data packet comprise a time slot identifier identifying the time slot in which the data packet is contained;

a receiver connected to the processing device, the processing device being arranged to obtain a time slot identifier from the data packets received by the receiver; and at least one first activating element, wherein the processing device is arranged to, upon the activating of the first element, to generate a pseudo random address, to store said address in an address register associated with the first activating element, and to transmit one or more data packets containing either the complete said address in each data packet, or an identifiable part of said address in each data packet.

12. The remote control device according to claim 11, further comprising at least one second activating element, each associated with a corresponding first activating element, wherein the processing device is arranged to, upon the activating of the second element, to transfer the content of the address register associated with the first activating element to the address register containing the address currently assigned to the device.

* * * * *